US006041791A

United States Patent [19]

Belmonte et al.

[11] Patent Number: 6,041,791

[45] Date of Patent: Mar. 28, 2000

[54] HAIR SETTING STRIP

[75] Inventors: Silvano Belmonte; Jacqueline Joan Bray, both of Mississauga, Canada

[73] Assignee: Masi Design Inc., Mississauga, Canada

[21] Appl. No.: 08/915,589

[22] Filed: Aug. 21, 1997

[51] Int. Cl.[7] ..... A45D 2/24

[52] U.S. Cl. ..... 132/222; 132/247; 132/264

[58] Field of Search ..... 132/222, 273, 132/275, 245, 246, 251, 247, 253

[56] References Cited

U.S. PATENT DOCUMENTS

| | | | |
|---|---|---|---|
| 2,936,766 | 5/1960 | Beverly | 132/247 |
| 3,426,767 | 2/1969 | Mercorella | 132/251 |
| 3,970,095 | 7/1976 | Prince et al. | 132/245 |
| 4,785,834 | 11/1988 | Gonzalez | 132/275 |
| 4,815,172 | 3/1989 | Ward | 24/16 R |
| 5,142,743 | 9/1992 | Hahn | 24/16 R |
| 5,293,884 | 3/1994 | Chapman et al. | 132/273 |
| 5,538,021 | 7/1996 | Kim | 132/245 |
| 5,662,128 | 9/1997 | Habibi | 132/247 |
| 5,694,954 | 12/1997 | Habibi | 132/222 |
| 5,715,846 | 2/1998 | Kim | 132/245 |
| 5,813,419 | 9/1998 | Brams . | |
| 5,819,762 | 10/1998 | Kim . | |

FOREIGN PATENT DOCUMENTS

| | | | |
|---|---|---|---|
| 787444 | 8/1997 | European Pat. Off. . | |
| 1389166 | 1/1965 | France . | |
| 2222973 | 10/1974 | France . | |
| 2416667 | 10/1979 | France | 132/251 |
| 1457422 | 2/1969 | Germany | 132/251 |
| 9311823 | 8/1993 | Germany . | |
| 19540684 | 5/1997 | Germany . | |
| 828302 | 2/1960 | United Kingdom | 132/245 |
| 2089657 | 6/1982 | United Kingdom . | |
| 2194437 | 3/1988 | United Kingdom . | |
| WO 97/13426 | 4/1997 | WIPO . | |

*Primary Examiner*—Todd E. Manahan
*Assistant Examiner*—Eduardo C. Robert
*Attorney, Agent, or Firm*—Doanld E. Hewson

[57] ABSTRACT

A hair setting strip for retaining a plurality of strands of hair and thereby setting a retained plurality of strands of hair in a desired style, comprises a thin resiliently pliant base member in the form of a strip having greater length than width, opposed first and second faces, and a longitudinal axis. A layer of hair-retentive material is securely mounted on the first face of the thin resiliently pliant base member. The hair setting strip is bendable along the longitudinal axis to a plurality of curved configurations, and is thereby selectively formable to any of the plurality of curved configurations. The hair setting strip may be retained in any selected curved configuration, whereby the retained plurality of strands of hair will become set in the desired style.

15 Claims, 3 Drawing Sheets

HAIR SETTING STRIP

FIELD OF THE INVENTION

This invention relates to devices for setting style into a person's hair, and more particularly to such devices that are adjustable so as to permit the size and shape of curls, waves, and the like set into a person's hair to be readily selected.

BACKGROUND OF THE INVENTION

It is common for women to fashion their hair in any number of different styles, including hair styles of reasonably straight hair and also very wavy or curly hair styles. Women who do not have naturally wavy or curly hair, but who want a wavy or curly hair style, must artificially introduce waves or curls into their hair. Conversely, women with wavy or curly hair may want to straighten out the waves or curls. Such curling, waving, or straightening of hair can be done by a professional hair stylist or can be done by an individual to her own hair.

DESCRIPTION OF THE PRIOR ART

In order to artificially introduce waves or curls into a person's hair, it is necessary to use a means such as rollers or the like. Typically, prior art hair rollers are cylindrical in shape, about three inches to four inches in length, and from about one inch to four inches in diameter, depending upon the amount of wave or curl that is desired. Prior art hair rollers have a material such as sponge around the periphery thereof, or are formed from plastic and have a plurality of projections disposed around the periphery thereof. Such hair rollers are retained in person's hair in any one of a variety of ways, including hair pins or integral devices on the rollers.

There are a number of disadvantages associates with all known prior art hair rollers. Since each prior art hair roller is of a fixed diameter, only one size of curl can be created with each size of hair roller. Therefore, more than one diameter of hair roller, would be required to set various sizes of waves or curls in a person's hair. Typically, a person might own one dozen, or even more, of each size of hair roller. Accordingly, it would be necessary for an individual to own a substantial number of hair rollers, perhaps even several dozen. Indeed, such a number of hair rollers would take up a considerable amount of room, especially for a person who is travelling and therefore probably has a limited amount of space in a suitcase, which is undesirable.

Similarly, in order to ensure the availability of a required number of types and sizes of hair rollers for all patrons, a hair salon would need to own many dozen of each of a wide range of sizes and styles of prior art hair rollers. Accordingly, it is necessary for a hair salon to own several hundred hair rollers, which is expensive and takes up a considerable amount of space.

Further, hairdressers who operate a "travelling salon" to meet the needs of people at home, such as the elderly, invalids, and so on, would need to carry about one or two dozen of each size of prior hair roller, which is expensive and takes up a considerable amount of room, and is therefore undesirable.

In use, a prior art hair roller in placed in a person's hair at the end of a plurality of strands of hair and the hair roller is rolled along the plurality of strands of hair such that several layers of hair are spiralled onto the hair roller. The first spiral layer of hair on the hair roller engages the periphery of the roller in an unobstructed manner; the second spiral layer of hair on the hair roller partially engages the periphery of the roller and partially engages the first spiral layer of hair; the third spiral layer of hair on the hair roller somewhat engages the periphery of the roller and mostly engages the first and second spiral layers of hair; and so on. Accordingly, it is common for the hair to become somewhat intertwined and tangled. It is therefore often difficult to remove a hair roller from a person's hair. Further, hair tends to tear when a hair roller is being removed from a prior art hair roller.

Also, since with prior art hair rollers only a portion of the hair engages the hair roller on the second, third, and subsequent spiral layers, only a small portion of the hair is in tension while being set, which leads to the hair possibly not setting as tightly as it should for the selected diameter of hair roller.

Further, lengths of hair that are rolled around a hair roller are all spiralled tightly together, irrespective of whether the outer portions of the spiral of hair contact the roller or merely contact hair underneath. Accordingly, there is no space between layers of hair spiralled onto a roller and thus the hair does not dry as quickly as it otherwise might.

It is an object of the present invention to provide an apparatus for rolling hair wherein one size of apparatus may be used to form waves and curls of virtually any selected size.

It is an object of the present invention to provide an apparatus for rolling hair, which apparatus is small and compact.

It is an object of the present invention to provide an apparatus for rolling hair that can be used to curl, wave, or straighten hair.

It is an object of the present invention to provide an apparatus for rolling hair that is easy to remove from a person's hair after use.

It is an object of the present invention to provide an apparatus for rolling hair that does not tear hair or pull hair out while being removed from a person's hair.

It is an object of the present invention to provide an apparatus for rolling hair that engages locks of hair along their entire length, thereby keeping the hair in tension and thereby resulting in better hair setting.

It is an object of the present invention to provide an apparatus for rolling hair that separates hair into layers when being rolled so as to provide for quicker drying of the hair.

SUMMARY OF THE INVENTION

In accordance with one aspect of the present invention, there is provided a hair setting strip for retaining a plurality of strands of hair and thereby setting a retained plurality of strands of hair in a desired style. The hair setting strip comprises a thin resiliently pliant base member in the form of a strip having greater length than width, opposed first and second faces, and a longitudinal axis. A layer of hair-retentive material is securely mounted on the first face of the thin resiliently pliant base member. The hair setting strip is bendable transverse to the longitudinal axis to a plurality of curved configurations, and is thereby selectively formable to any of the plurality of curved configurations. The hair setting strip may be retained in any selected curved configuration, whereby the retained plurality of strands of hair will become set in the desired style.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

Figure 1:
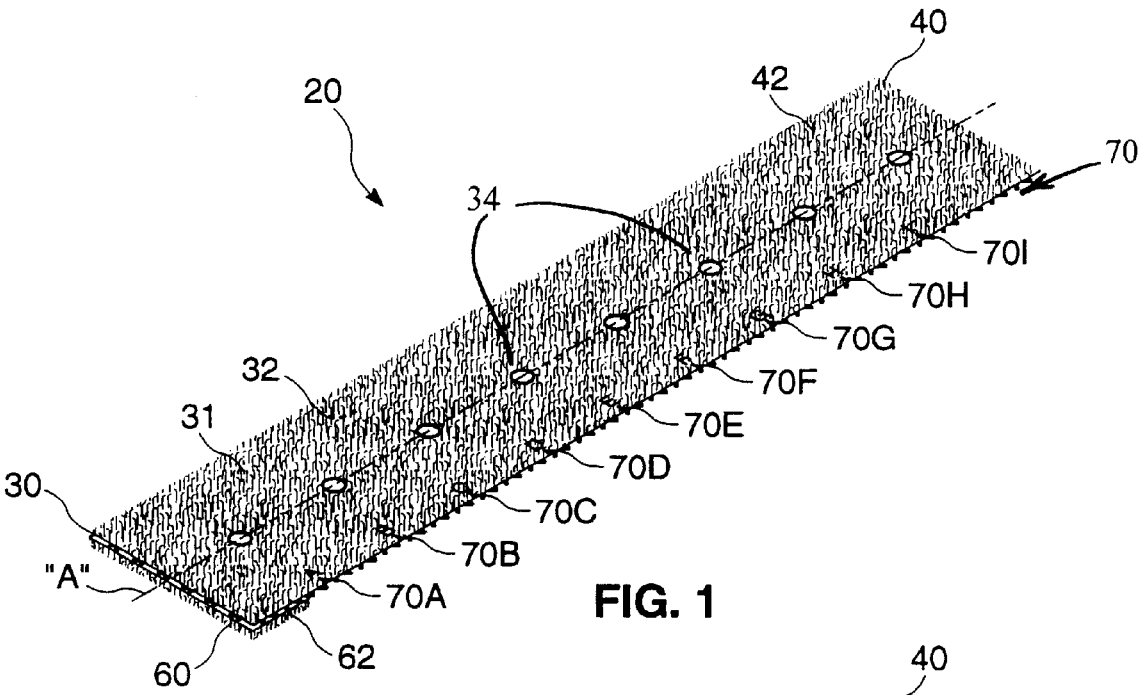
FIG. 1 is a perspective view of an embodiment of a hair setting strip according to the present invention.
Figure 2:
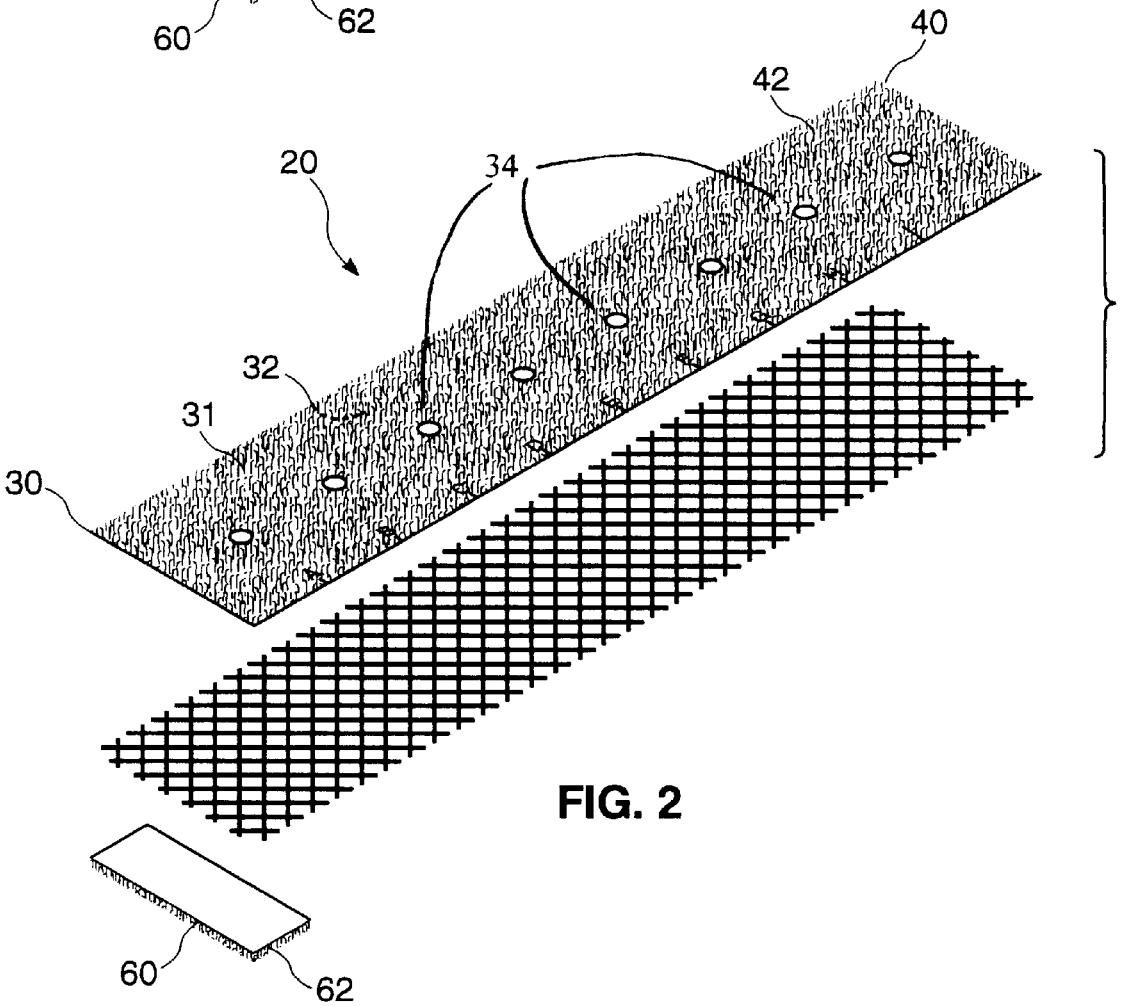
FIG. 2 is a perspective exploded view of an embodiment of a hair setting strip according to the present invention.

Reference will now be made to FIGS. 1 through 5, which show embodiments of the hair setting strip of the present invention, as indicated by the general reference numeral 20. The hair setting strip 20 is for retaining a plurality of strands of hair 22, and thereby setting the retained plurality of strands of hair 22 in a desired style, as will be discussed in greater detail subsequently with respect to FIGS. 6 through 11.

The hair setting strip 20 comprises a thin resiliently pliant base member 30 in the form of a strip having a length "L" and a width "W", which length "L" is greater than the width "W". The thin resiliently pliant base member 30 also has opposed first and second faces 31,32, and a longitudinal axis "A".

A layer of hair-retentive material 40 is securely mounted on the first face 31 of the thin resiliently pliant base member 30. Preferably, the layer of hair-retentive material 40 covers substantially the entire surface of the first face 31 of the thin resiliently pliant base member 30, but not necessarily. In the preferred embodiments, the layer of hair-retentive material 40 comprises the hook portion of a hook and loop fastening system. Essentially, in use, the hooks 42 hook onto the strands of hair 22, so as to releasably retain the strands of hair 22. In their preferred form, the hooks 42 are merely shaped in the form of a curve. Such curved types of hooks 42 tends to more readily release the loop portion of a hook and loop fastening system than do the hooks in other types of hook and loop type fastening systems (not shown), such as those where the hooks are essentially barb-shaped.

One advantage of using the hook portion of a hook and loop fastening system as the layer of hair-retentive material 40 is that there is a substantial amount of space between the individual hooks, which space permits air flow through the hooks and through the resiliently pliant base member 30. Thus, the layer of hair-retentive material 40 and the resiliently pliant base member 30 are air permeable, which therefore facilitates the ready drying of the strands of hair 22, when the hair setting strip 20 is secured in place retaining a plurality of strands of hair, as will be discussed in greater detail subsequently with respect to FIGS. 6 through 11.

The hair setting strip 20 may further comprise a thin resiliently pliant stiffening member 50 securely mounted on the second face 32 of the thin resiliently pliant base member 30, by means of a suitable adhesive, by ultrasonic fusing, or by any other suitable means. The thin resilient pliant stiffening member 50 is also perforated so as to be air permeable, and thus so as to permit air flow therethrough, also in order to facilitate the ready drying of the strands of hair 22. It has been found that a readily deformable plastic, such as vinyl, is a suitable material for use in fabrication of the thin resilient pliant stiffening member 50, but any suitable material may be used.

As can be best seen in FIGS. 7 through 10, the hair setting strip 20 of the present invention is bendable along its longitudinal axis to any one of a plurality of curved configurations, and is thereby selectively formable to any one of these plurality of curved configurations.

Figure 7:
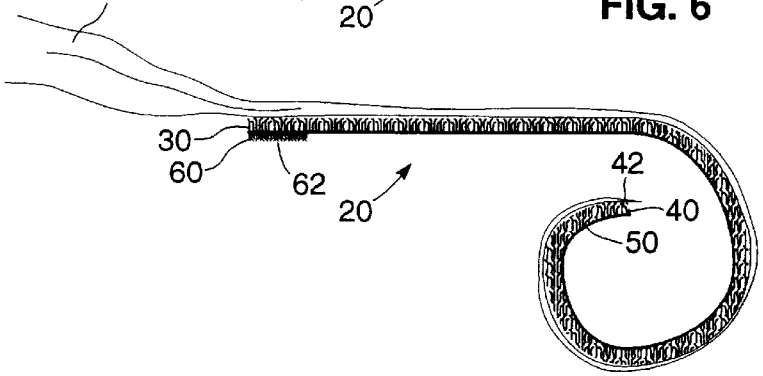
FIG. 7 shows the hair setting strip of FIG. 6, being rolled into a spiral configuration.
Figure 8:
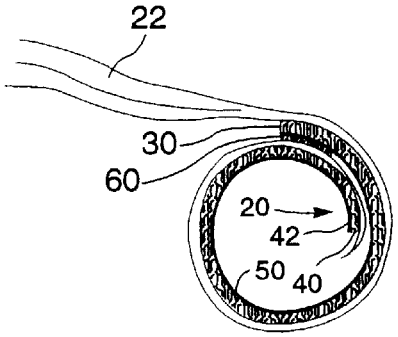
FIG. 8 shows the hair setting strip of FIG. 6, having been rolled into a large spiral configuration so as to set the engaged hair into loose curls.
Figure 9:
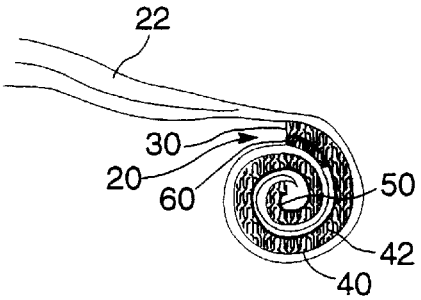
FIG. 9 shows the hair setting strip of FIG. 6, having been rolled into a small spiral configuration so as to set the engaged hair into tight curls.

More specifically, as can be seen in FIGS. 7 through 9, the hair setting strip 20 is windable transverse to its longitudinal axis to a plurality of spiral configurations such that the layer of hair-retentive material 40 is outwardly facing in the spiral configurations. It is important that the layer of hair-retentive material 40 is outwardly facing since the strands of hair 22 engaged by the hair-retentive material 40 must be tensioned slightly in order to set properly. FIG. 7 shows the hair setting strip 20 being initially spiralled. FIG. 8 shows the hair setting strip 20 spiralled to a relatively large spiral, for producing correspondingly loose curls. FIG. 9 shows the hair setting strip 20 being spiralled to a relatively small spiral, thereby producing corresponding tight curls in the retained strands of hair 22.

Figure 10:
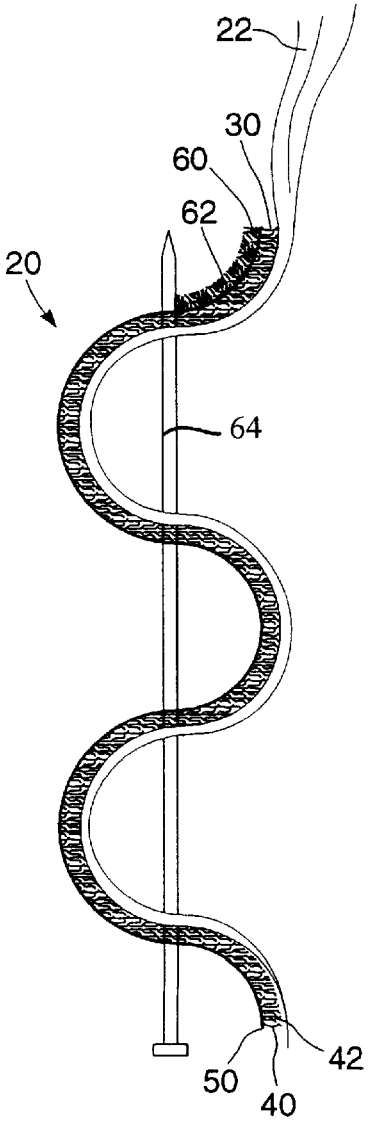
FIG. 10 is a side elevational view of the hair setting strip of FIG. 2, having a plurality of strands of hair engaged thereon, and having been placed into a serpentine configuration so as to set the engaged hair into a wave.

The hair setting strip 20 is also bendable transverse to its longitudinal axis to a plurality of serpentine configurations, one of which is shown in FIG. 10. Such serpentine configurations are used to set a wave in a person's hair.

The hair setting strip 20 may further comprise securing means 60 for securely retaining the hair setting strip 20 in any selected curved configuration. In a preferred embodiment thereof, the securing means 60 comprises the loop portion of a hook and loop fastening system. The loops 62 of the loop portion securing means 60 are releasably engagable with the hook portion of the hook and loop fastening system, when the hair setting strip 20 is retaining a plurality of strands of hair 22 and the hair setting strip 20 has been wound to any one of its spiral configurations, as can be best seen in FIGS. 8 and 9. Since the hook portion of the hook and loop fastening system covers substantially the entire surface of the first face 31 of the thin resiliently pliant base member 30, the loop portion securing means 60 can be engaged anywhere along the length thereof, thus readily permitting a continuum of sizes of spirals to be formed and securely retained in place.

In order to retain the hair setting strip 20 in the serpentine configuration it is set to, a securing means comprising an elongate pin 64 is inserted through a plurality of aligned apertures 34 in the base member 30 of the hair setting strip 20, which aligned apertures 34 are adapted for receiving the elongate pin 64 therethrough.

Alternatively, another securing means may comprise a cross-clip or a hair pin (not shown).

It can be seen that the hair setting strip 20 may be secured in place in any one of a plurality of selected curved configurations, such as any spiral configuration, serpentine configuration, or other configurations, as desired. The retained plurality of strands of hair 22 will become set in the desired style, according to the curved configuration that the hair setting strip 20 is secured in.

Figure 11:
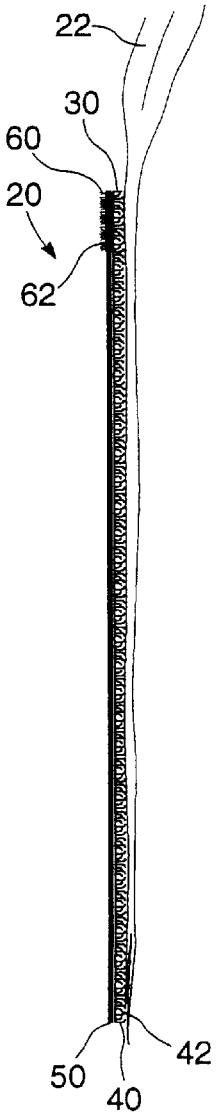
FIG. 11 is a side elevational view of the hair setting strip of FIG. 2, having a plurality of strands of hair engaged thereon, and having been placed into a straight configuration so as to straighten the engaged hair.

In addition to the above discussed curling and waving of hair, the hair setting strip 20 of the present invention may be used to straighten curly or wavy hair, as is shown in FIG. 11, by merely engaging the strands of hair 22 on the layer of hair-retentive material 40, with the hair setting strip 20 in a substantially straight configuration.

Figure 3:
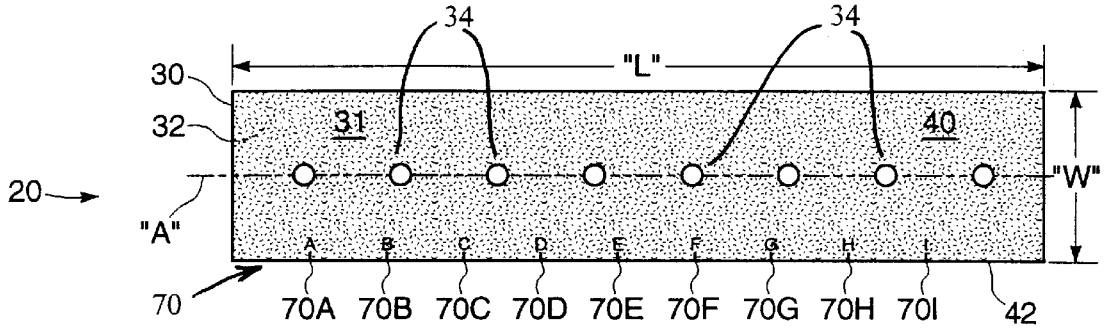
FIG. 3 is a top plan view of the embodiment of the hair setting strip of FIG. 1.
Figure 4:
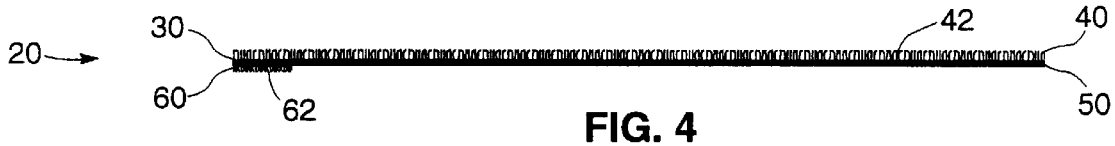
FIG. 4 is a side elevational view of the embodiment of the hair setting strip of FIG. 2.
Figure 5:
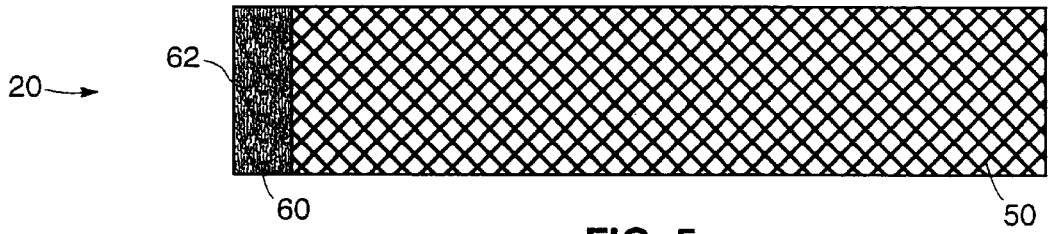
FIG. 5 is a bottom plan view of the embodiment of the hair setting strip of FIG. 2.

The hair setting strip 20 of the present invention further includes gauging means, in the form of a plurality of indicia 70, specifically 70A through 70I, disposed substantially along the length of the base member 30, preferably along one edge thereof, as can best be seen in FIG. 3. The indicia 70 are used when the hair setting strip 20 is wound to a spiral configuration to set the hair setting strip 20 to a specific size of spiral configuration, as will be discussed in greater detail subsequently.

Figure 6:
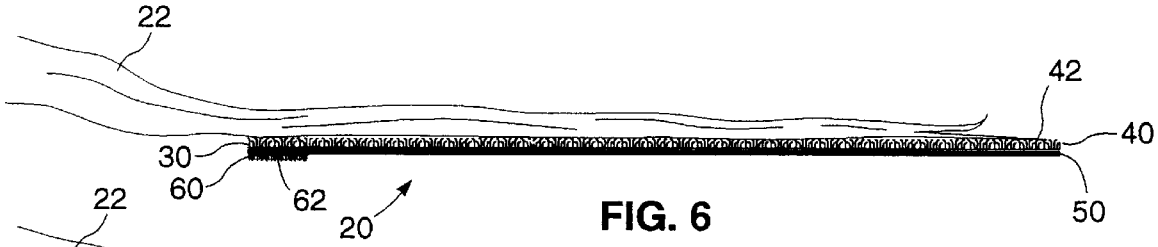
FIG. 6 is a side elevational view of the hair setting strip of FIG. 2, having a plurality of strands of hair engaged thereon, before being rolled into a spiral configuration.

In use, the hair setting strip 20 is first placed under a plurality of strands of hair 22 with the layer of hair-retentive material 40 facing upwardly, so as to engage the plurality of strands of hair 22, as is particularly shown in FIG. 6. The outer end of the hair setting strip 20 may then be spiralled until the end portion of the second face 32 contacts itself, or the thin resiliently pliant stiffening member 50. The indicia 70 disposed substantially along the base of the base member 30 are used to set this initial size of spiral by aligning any one of the indicia 70B through 701 with the first indicia 70A. The hair setting strip 20 is then wound under the strands of hair 22 so as to form a spiral configuration. The loop portion securing means 60 may then engage the layer of hair-retentive material 40, thus securely retaining the hair setting strip 20 in that selected spiral configuration. Alternatively, as noted above, a pin 64 may be passed through several aligned apertures 34, along the longitudinal axis "A" of the hair setting strip 20, to retain it in the selected spiral configuration. Once a person's hair has substantially dried, the securing means is removed. The hair setting strip 20 is then unwound from its spiral configuration, and the hair setting strip 20 is removed from engagement with the plurality of strands of hair 22. Since the hair setting strip 20 is unwound before being removed from engagement with the plurality of strands of hair 22, tearing of the hair is substantially precluded.

In order to set a wave into a person's hair, the hair setting strip 20 is first placed under a plurality of strands of hair 22 with the layer of hair-retentive material 40 facing upwardly, so as to engage the plurality of strands of hair 22, as shown in FIG. 6. The hair setting strip 20 is then bent to the desired shaped as is shown in FIG. 10, and the elongate pin 64 is then inserted through the aligned apertures 34 in the hair setting strip 20. Once a person's hair has substantially dried, the securing means—namely the elongate pin 64—is then removed from the aligned apertures 34 in the hair setting strip 20. The hair setting strip 20 is then removed from engagement with the plurality of strands of hair 22, with tearing of the hair being substantially precluded. Also, the hair may be straightened as noted above with respect to FIG. 11.

Other modifications and alterations may be used in the design and manufacture of the apparatus of the present invention without departing from the spirit and scope of the accompanying claims.

What is claimed is:

1. A hair setting strip for retaining a plurality of strands of hair and thereby setting a retained plurality of strands of hair in a desired style, said hair setting strip comprising:

a thin resiliently pliant base member in the form of a strip, having greater length than width, opposed first and second faces, and a longitudinal axis;

a thin resiliently pliant stiffening member securely mounted on the second face of said thin resiliently pliant base member; and a layer of hair-retentive material securely mounted on the first face of said thin resiliently pliant base member, along the length of which said plurality of strands of hair are retained;

wherein each of said thin resiliently pliant base member and said thin resiliently pliant stiffening member is air permeable, so as to permit the flow of air therethrough; and wherein said thin resiliently pliant base member is bendable transverse to said longitudinal axis to a plurality of curved configurations, and is thereby selectively formable to any of said plurality of curved configurations; and wherein said hair setting strip may be secured in any selected curved configuration, whereby said retained plurality of strands of hair will become set in said desired style.

2. The hair setting strip of claim 1, wherein said thin resiliently pliant stiffening member is perforated so as to permit air flow therethrough.

3. The hair setting strip of claim 1, wherein said layer of hair-retentive material comprises a hook portion of a hook and loop fastening system.

4. A method of using a hair setting strip, comprising the steps of:

(a) utilizing the hair setting strip of claim 3, (b) conforming said hair setting strip in a substantially straight configuration; and (c) engaging a plurality of strands of hair on said layer of hair-retentive material so that said plurality of strands of hair is retained by said hair-retentive material, so as to straighten said retained plurality of strands of hair.

5. The hair setting strip of claim 3, wherein said layer of hair-retentive material covers substantially the entire surface of the first face of said thin resiliently pliant base member.

6. The hair setting strip of claim 3, further comprising securing means for securely retaining said hair setting strip in any selected curved configuration.

7. The hair setting strip of claim 6, wherein said hair setting strip is bendable transverse to said longitudinal axis to a plurality of serpentine configurations.

8. The hair setting strip of claim 7, wherein said securing means comprises an elongate pin insertable through said hair setting strip when said hair setting strip is retaining a plurality of strands of hair.

9. The hair setting strip of claim 8, wherein said hair setting strip has a plurality of aligned apertures therein for receiving said elongate pin therethrough.

10. The hair setting strip of claim 6, wherein said hair setting strip is windable transverse to said longitudinal axis to a plurality of spiral configurations such that said layer of hair-retentive material is outwardly facing in said spiral configurations.

11. The hair setting strip of claim 10, wherein said securing means comprises a loop portion of a hook and loop fastening system, which loop portion is secured to said second face of said resiliently pliant base member so as to be releasably engagable with said hook portion of said hook and loop fastening system, when said hair setting strip is retaining a plurality of strands of hair and said hair setting strip has been wound to any one of said spiral configurations.

12. The hair setting strip of claim 10, wherein said hair setting strip further includes gauging means disposed substantially along the length of said base member, for setting said hair setting strip to a spiral configuration of a selected size.

13. The hair setting strip of claim 12, wherein said gauging means comprises a plurality of indicia disposed substantially along the length of said base member.

14. The hair setting strip of claim 10, wherein said securing means comprises an elongate pin insertable through said hair setting strip when said hair setting strip is retaining a plurality of strands of hair.

15. The hair setting strip of claim 14, wherein said hair setting strip has a plurality of aligned apertures therein for receiving said elongate pin therethrough.

* * * * *